US011597117B2

(12) United States Patent
Schittl et al.

(10) Patent No.: US 11,597,117 B2
(45) Date of Patent: Mar. 7, 2023

(54) WALL SAW HAVING A LOCKING DEVICE

(71) Applicant: Hilti Aktiengesellschaft, Schaan (LI)

(72) Inventors: Josef Schittl, Thueringen (AT); Bruno Werder, Gamprin (LI); Walter Nessler, Ludesch (AT)

(73) Assignee: Hilti Aktiengesellschaft, Schaan (LI)

( * ) Notice: Subject to any disclaimer, the term of this patent is extended or adjusted under 35 U.S.C. 154(b) by 342 days.

(21) Appl. No.: 16/954,958

(22) PCT Filed: Nov. 29, 2018

(86) PCT No.: PCT/EP2018/083004
§ 371 (c)(1),
(2) Date: Jun. 17, 2020

(87) PCT Pub. No.: WO2019/120925
PCT Pub. Date: Jun. 27, 2019

(65) Prior Publication Data

US 2020/0376704 A1 Dec. 3, 2020

(30) Foreign Application Priority Data

Dec. 22, 2017 (EP) ..... 17209957

(51) Int. Cl.
*B27B 5/32* (2006.01)
*B28D 1/04* (2006.01)

(52) U.S. Cl.
CPC ..... *B27B 5/32* (2013.01); *B28D 1/044* (2013.01); *B28D 1/045* (2013.01)

(58) Field of Classification Search
CPC ..... B28D 1/044; B28D 1/045; B27B 5/32
See application file for complete search history.

(56) References Cited

U.S. PATENT DOCUMENTS 51,478 A * 12/1865 Rand ..... B27B 5/32 126/156
114,926 A * 5/1871 Colborn ..... B27B 5/32 83/666
3,623,281 A * 11/1971 Moffat ..... B24D 7/16 451/509
5,887,579 A * 3/1999 Eriksson ..... B28D 1/045 125/14

(Continued)

FOREIGN PATENT DOCUMENTS

EP 0 785 054 B1 10/2002

OTHER PUBLICATIONS

International Search Report of PCT/EP2018/082016, dated Feb. 18, 2019.

*Primary Examiner* — Sean M Michalski
(74) *Attorney, Agent, or Firm* — Davidson, Davidson & Kappel, LLC

(57) ABSTRACT

Wall saw having a locking device (41). A saw blade flange (25) of the wall saw is adjustable by the locking device (41) between a locked state and an unlocked state, wherein, in the locked state, the saw blade flange (25) is connected to the drive spindle (33) for rotation therewith, and, in the unlocked state, is adjustable in relation to the drive spindle (33). In the unlocked state of the saw blade flange, the drive spindle is blocked in the direction of rotation of the saw blade and is designed to be rotatable about the axis of rotation in a counter direction directed counter to the direction of rotation.

8 Claims, 5 Drawing Sheets

(56) References Cited

U.S. PATENT DOCUMENTS

| | | | | |
|---|---|---|---|---|
| 9,089,989 | B2 * | 7/2015 | Hortling | B27B 5/32 |
| 9,327,424 | B2 * | 5/2016 | JÖNsson et al. | B23D 47/12 |
| 9,486,909 | B2 * | 11/2016 | Zieger | B27B 5/32 |
| 2014/0084552 | A1 * | 3/2014 | Zieger | B24B 23/022 279/141 |
| 2015/0183107 | A1 * | 7/2015 | Ito | B24B 23/04 279/141 |
| 2017/0050291 | A1 * | 2/2017 | Aoki | B23D 51/10 |
| 2019/0366502 | A1 * | 12/2019 | Aoki | B24B 23/022 |
| 2020/0164450 | A1 * | 5/2020 | Li | B27B 5/32 |
| 2021/0354258 | A1 * | 11/2021 | Guazzoni | B23Q 3/15713 |

* cited by examiner

WALL SAW HAVING A LOCKING DEVICE

The present invention relates to a wall saw having a locking device.

BACKGROUND

When wall saws are used for separating a workpiece between a first and a second end point, it is conventional to carry out the separating cut in a plurality of partial cuts using saw blades of differing size. If use is made of a plurality of saw blades, the processing generally begins with the smallest saw blade diameter and the saw blade has to be changed between the partial cuts.

EP 0 785 054 B1 discloses an equipment system with a wall saw and a guide rail. The wall saw has a saw head and a motorized feed unit. The saw head comprises a saw blade which is fastened to a saw arm and is driven about an axis of rotation by a drive motor. The saw arm is designed to be pivotable and is adjusted about a pivot axis by a pivoting motor. The motorized feed unit comprises a guide carriage and a feed motor, wherein the saw head is arranged on the guide carriage and is moved along the guide rail via the feed motor. The saw blade is driven about the axis of rotation via the drive motor, a drive spindle and a transmission device which connects the drive spindle to the drive motor in a torque-transmitting manner. The saw blade is fastened on the drive spindle by means of a saw blade flange. The saw blade flange consists of two flange halves, wherein a first flange half is connected to the drive spindle and a second flange half is connected to the saw blade. The first and second flange halves are connected to one another via a screw connection. The circumference of the first flange half is provided with radially arranged securing screws which are screwed into corresponding radial bores having an internal thread in the second flange half. It is disadvantageous that the operator has to remove the saw blade in order to release the screw connection between the flange halves.

SUMMARY OF THE INVENTION

It is an object of the present invention, in the case of a wall saw, to simplify the locking of the saw blade flange on the drive spindle for the operator. In addition, the changing of a saw blade between partial cuts of a separating cut is intended to be made easier for the operator.

According to the invention, it is provided that, in the unlocked state of the saw blade flange, the drive spindle is blocked in the direction of rotation of the saw blade and is rotatable about the axis of rotation in a counter direction directed counter to the direction of rotation. In the unlocked state of the saw blade flange, the saw blade flange is not connected to the drive spindle for rotation therewith and is designed to be adjustable in relation to the drive spindle. The design according to the invention of the drive spindle has the advantage that an unintentional starting of the saw blade in the unlocked state of the saw blade flange is prevented. Owing to the fact that the drive spindle is rotatable about the axis of rotation in the counter direction directed counter to the direction of rotation, the operator can move the saw blade or the drive spindle into an angular position which makes it easier for the operator to change the saw blade.

The wall saw preferably has a motorized feed unit with a guide carriage and a feed motor, wherein the saw head is arranged on the guide carriage and is movable by the feed motor along a guide rail in a feed direction. The design according to the invention of the wall saw is advantageous in the case of large and heavy machine tools which are not designed to be guided manually, but rather have a motorized feed unit moving the machine tool along a guide rail.

The locking device preferably has a tie rod, which is guided in the interior of the drive spindle, and a first connecting element, and the saw blade flange has a second connecting element, wherein the first and second connecting elements are connectable in a force-fitting and/or form-fitting manner. In the locked state of the saw blade flange, the first and second connecting elements are particularly preferably connected in a force-fitting and/or form-fitting manner.

In a preferred embodiment, the wall saw has a safety device. The safety device preferably has a lever, a latch and an axle element which connects the lever and the latch to each other.

In the locked state of the saw blade flange, the lever is particularly preferably adjustable between a first and second end position, wherein the latch blocks a transmission of torque in the direction of rotation of the saw blade in the first end position of the lever and releases same in the second end position of the lever. The lever can be adjusted by the operator from the first end position into the second end position only when the tool holder for the tool is recessed in the saw arm housing.

In the unlocked state of the saw blade flange, the latch particularly preferably blocks a rotation of the drive spindle in the direction of rotation of the saw blade and releases the rotation of the drive spindle in the counter direction directed counter to the direction of rotation.

Exemplary embodiments of the invention are described hereinafter with reference to the drawing. It is not necessarily intended for these to illustrate the exemplary embodiments to scale; instead, the drawing, where conducive to elucidation, is executed in schematic and/or slightly distorted form. It should be taken into account here that various modifications and alterations relating to the form and detail of an embodiment may be undertaken without departing from the general concept of the invention. The general concept of the invention is not limited to the exact form or the detail of the preferred embodiment shown and described hereinafter or limited to subject matter that would be limited compared to the subject matter claimed in the claims. For given design ranges, values within the limits mentioned shall also be disclosed as limiting values and shall be usable and claimable as desired. For the sake of simplicity, identical reference numerals are used hereinafter for identical or similar parts or parts having identical or similar function.

DETAILED DESCRIPTION

Figure 1:
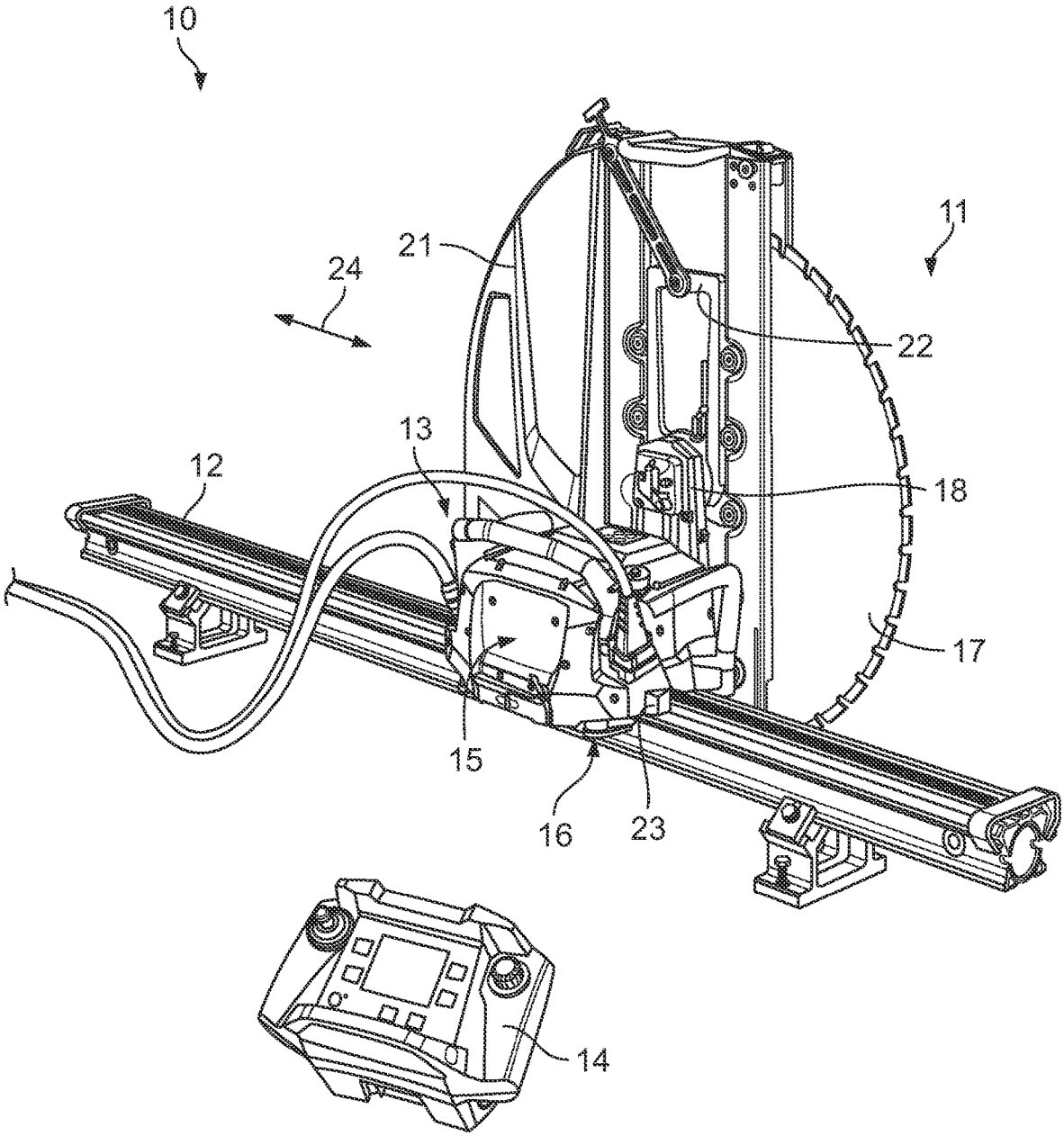
FIG. 1 shows an equipment system having a guide rail and a wall saw which comprises a processing and feed unit which is arranged displaceably along the guide rail and has a saw head and a motorized feed unit.

FIG. 1 shows an equipment system 10 with a machine tool 11, which is in the form of a wall saw, and a guide rail 12. The wall saw 11 comprises a processing and feed unit 13 arranged displaceably on the guide rail 12, and a remote control 14. The processing and feed unit 13 comprises a processing unit 15 and a motorized feed unit 16. The processing unit 15 is in the form of a saw head and comprises a saw blade 17 which is fastened to a saw arm 18 and is driven about an axis of rotation 19 by a drive motor.

In order to protect the operator, the saw blade 17 is surrounded by a saw blade guard 21 which is fastened to the saw arm 18 by means of a blade guard holder 22. The saw arm 18 is designed to be pivotable about a pivot axis by means of a pivoting motor. The pivot angle of the saw arm 18 together with a saw blade diameter of the saw blade 17 determines the depth to which the saw blade 17 enters into a workpiece to be processed. The motorized feed unit 16 comprises a guide carriage 23 and a feed motor. The saw head 15 is fastened on the guide carriage 23 and is designed to be displaceable along the guide rail 12 in a feed direction 24 (double arrow) via the feed motor.

Figure 2A:
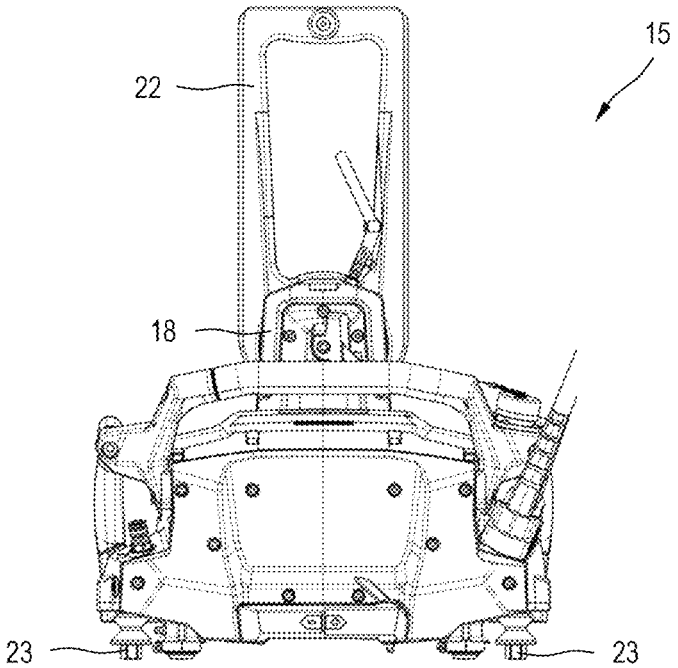
FIG. 2A and FIG. 2B show the saw head of FIG. 1 in a front view (FIG. 2A) and a rear view (FIG. 2B)
Figure 2B:
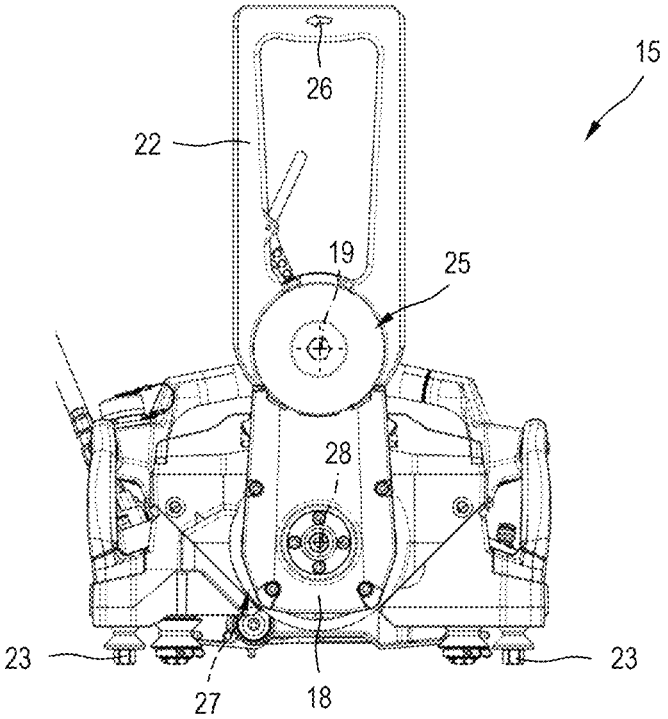

FIGS. 2A and 2B show the saw head 15 of the wall saw 11 with the pivotable saw arm 18 in detail, wherein the saw blade 17 and the saw blade guard 21 have been removed. FIG. 2A shows the saw head 15 in a front view facing the saw arm, and FIG. 2B shows the saw head 15 in a rear view facing away from the saw arm.

The saw blade 17 is mounted on the saw arm 18 by means of a saw blade flange 25 and, during operation of the wall saw 12, rotates in one direction of rotation 26 about the axis of rotation 19. The saw arm 18 is designed to be pivotable about a pivot axis 28 by means of a pivoting motor 27; alternatively, the saw arm 18 can be designed to be adjustable by means of a linear drive or another drive device.

Figure 3:
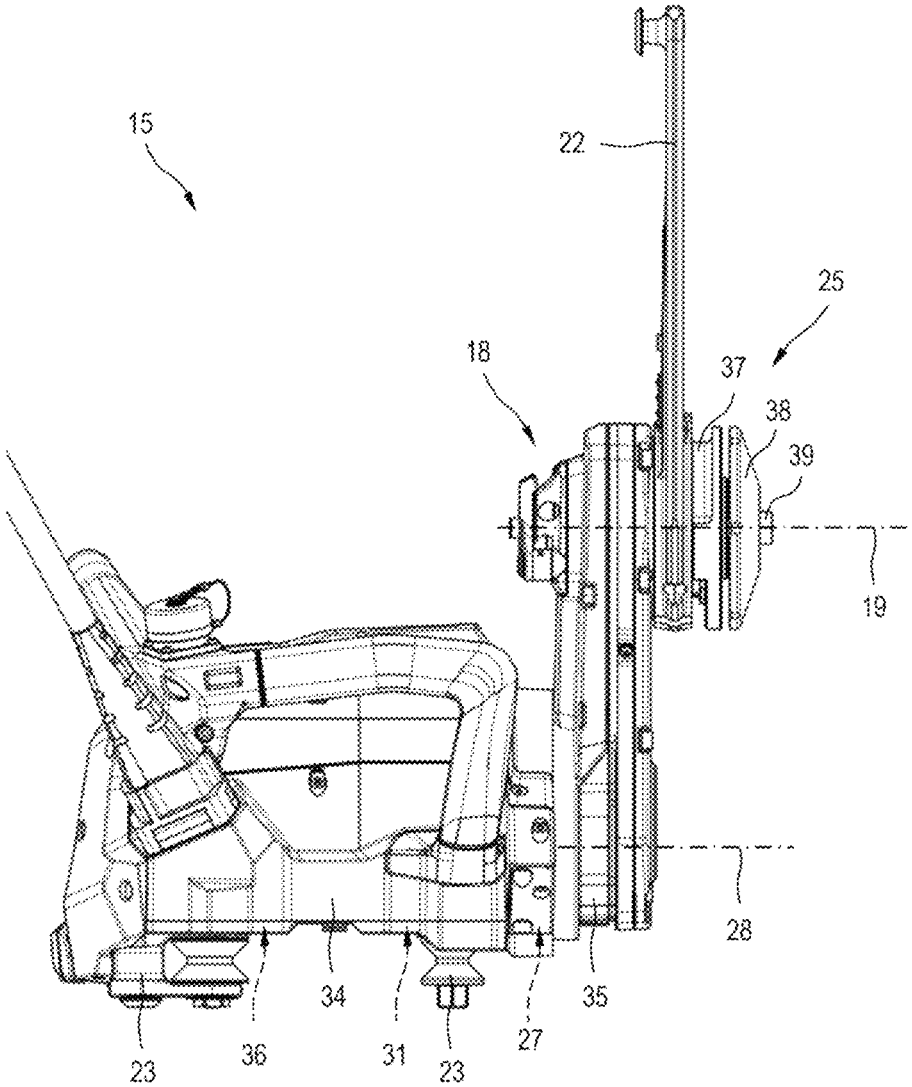
FIG. 3 shows the saw head of FIG. 1 without a saw blade which can be arranged on a drive spindle by means of a saw blade flange, in a side view.

FIG. 3 shows the saw head 15 of the wall saw 11 without saw blade 17 and saw blade guard 21, in a side view. The saw blade 17 is connectable by means of the saw blade flange 25 to the saw arm 18 for rotation therewith. The saw blade 17 is driven about the axis of rotation 19 via a drive motor 31, a transmission device 32 and a drive spindle 33. The drive motor 31 is arranged in a motor housing 34 and is connected to the transmission device 32, which is in the form of a planetary transmission in the exemplary embodiment, for rotation therewith. The planetary transmission 32 is at least partially arranged in a saw arm housing 35 of the saw arm 18. In the exemplary embodiment, the final stage of the planetary transmission 32 is connected to the drive spindle 33 (see FIGS. 4A and 4B) in a torque-transmitting manner.

The saw head 15 is fastened on the guide carriage 23 and is moved along the guide rail 12 by a feed motor 36. The feed motor 36, the pivoting motor 27 and the drive motor 31 can be in the form of separate motors or can be integrated into one or more motors. In the exemplary embodiment, all of the motors 27, 31, 36 of the wall saw 11 are arranged in the motor housing 34.

In the exemplary embodiment of FIG. 3, the saw blade flange 25 is formed in multiple parts and comprises an inner flange 37, an outer flange 38 and a fastening screw 39. The inner flange 37 is mounted on the drive spindle 33 for rotation therewith (see FIGS. 4A and 4B), the saw blade 17 and the outer flange 38 are subsequently pushed successively onto the drive spindle 33 and, finally, the outer flange 38 is fastened via the fastening screw 39. The fastening screw 39 is tightened until the saw blade 17 is clamped between the inner flange 37 and the outer flange 38 for rotation therewith. Alternatively to the shown multi-part saw blade flange 25 consisting of inner flange and outer flange 37, 38, a single-part saw blade flange can be used for flush cuts, and is also referred to as a flush cut flange.

Figure 4A:
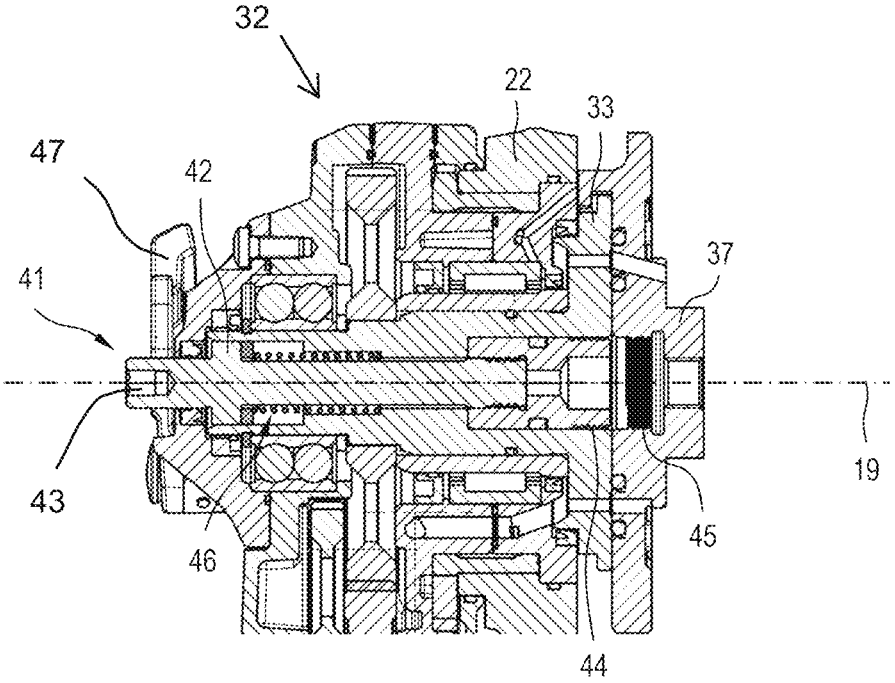
FIG. 4A and FIG. 4B show the drive spindle and the saw blade flange of FIG. 3 which are connectable to each other by means of a locking device, in an unlocked state (FIG. 4A) and in a locked state (FIG. 4B)
Figure 4B:
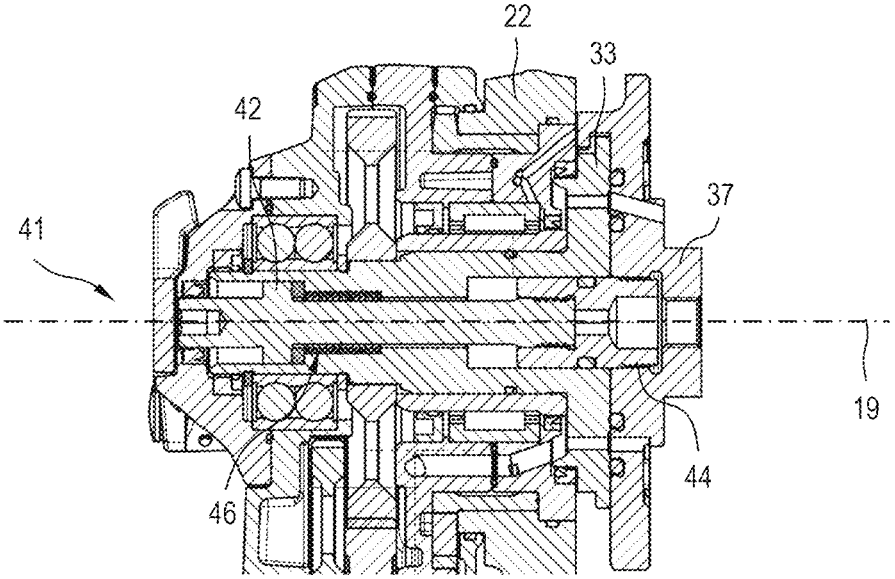

FIGS. 4A and 4B show the drive spindle 33 and the saw blade flange 25 (see FIG. 3), which is arranged on the drive spindle 33, in an unlocked state (FIG. 4A) and in a locked state (FIG. 4B). The saw blade flange 25 consists of the inner flange 37, which is connected to the drive spindle 33 for rotation therewith, and of the outer flange 38 and the fastening screw 39 (see FIG. 3). In the unlocked state, the inner flange 37 is designed to be adjustable in relation to the drive spindle 33 and, in the locked state, the inner flange 37 is connected to the drive spindle 33 for rotation therewith.

The inner flange 37 is locked via a locking device 41 which is formed in multiple parts in the exemplary embodiment. The locking device comprises a rod 42 which is in the form of a tie rod and is guided in the interior of the drive spindle 33, a tool holder 43 and a first connecting element 44. The tool holder 43 is provided at an end of the tie rod 42 that faces away from the inner flange 37 and, in the exemplary embodiment, is in the form of a recessed Torx receptacle. The first connecting element 44 is provided at an end of the tie rod 42 that faces the inner flange 37 and, in the exemplary embodiment, is in the form of an external thread.

The external thread 44 is formed in a complementary manner to a bore with an internal thread 45, which bore is provided in the inner flange 37 and forms a second connecting element. The drive spindle 33 is hollow and in the interior forms a guide for the tie rod 42. The tie rod 42 is preloaded in the tensile direction by a spring 46 which is arranged in a cavity of the drive spindle 33, the cavity surrounding the tie rod 42. The tie rod 42 is moved via a tool which is connectable to the tie rod 42 via the tool holder 43 and which, in the exemplary embodiment, is in the form of a Torx wrench.

In order to transfer the inner flange 37 from the unlocked state (FIG. 4A) into the locked state (FIG. 4B), the Torx wrench is pushed into the tool holder 43. The tie rod 42 is first of all displaced by means of the Torx wrench in the axial direction along the axis of rotation 19 counter to the spring tension of the spring 46 until the external thread 44 of the tie rod 42 engages in the internal thread 45 of the inner flange 37. By rotation of the Torx wrench about the axis of rotation 19, the external thread 44 is screwed into the internal thread 45. The external thread 44 of the tie rod 42 and the internal thread 45 of the inner flange 37 form a force-fitting and form-fitting connection between the inner flange 37 and the tie rod 42. The threaded connection between the inner flange 37 and the tie rod 42 is completely formed if the tool holder 43 is formed flush in relation to the saw arm housing 35 or is set back in relation to the saw arm housing 35 toward the inner flange 37.

In order to ensure that, during operation of the saw blade 17, the inner flange 37 is securely connected to the drive spindle 33, the external thread 44 of the tie rod 42 has to be screwed over a minimum height into the internal thread 45 of the inner flange 37. The wall saw 12 has a safety device 47 which ensures that the external and internal threads 44, 45 are connected in a form-fitting manner over the minimum height. That side of the saw arm housing 35 which faces away from the flange is provided with a lever 48 which is part of the safety device 47 and which is adjustable about an adjustment axis 49 between a first end position and a second end position (see FIG. 5A and FIG. 6A). The position of the lever 48 illustrated in FIG. 4A is referred to as the first end position and the position of the lever 48 illustrated in FIG. 4B is referred to as the second end position.

Figure 5A:
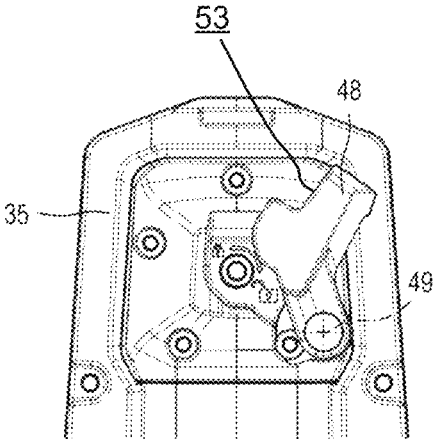
FIG. 5A and FIG. 5B show a safety device in a first end position which corresponds to the unlocked state of the saw blade flange that is illustrated in FIG. 4A.
Figure 6A:
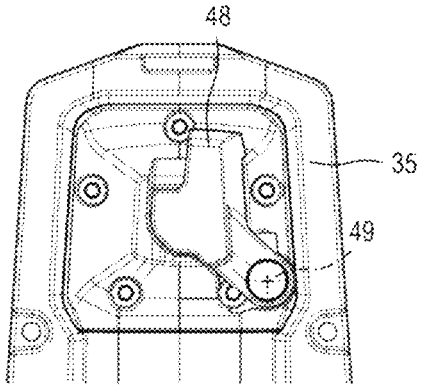
FIG. 6A and FIG. 6B show the safety device in a second end position which corresponds to the locked state of the saw blade flange that is illustrated in FIG. 4B.
Figure 5B:
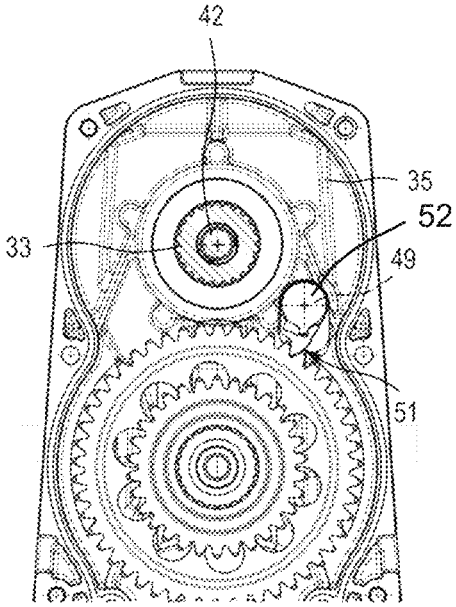
Figure 6B:
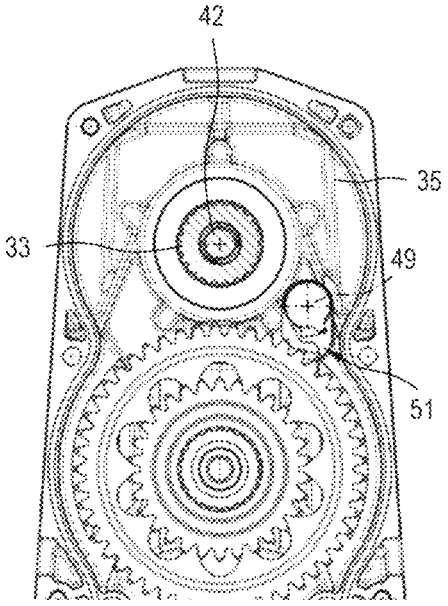

FIGS. 5A and 5B show the safety device 47 in a first position which corresponds to the first end position of the lever 48, and FIGS. 6A and 6B show the safety device 47 in a second position which corresponds to the second end position of the lever 48. In addition to the lever 48, the safety device 47 comprises a latch 51, an axle element 52 which connects the lever 48 and the latch 51 rigidly to each other, and a pushbutton 53.

FIG. 5A shows the lever 48 in the first end position which corresponds to the unlocked state of the inner flange 37 that is illustrated in FIG. 4A; and FIG. 6A shows the lever 48 in the second end position which corresponds to the locked state of the inner flange 37 that is illustrated in FIG. 4B. The lever 48 can be adjusted by the operator from the first end position into the second end position only when the tool holder 43 for the Torx wrench is recessed in the saw arm housing 35.

What is claimed is:

1. A wall saw comprising:

a drive spindle mounted rotatably about an axis of rotation;

a drive motor and a transmission connecting the drive motor to the drive spindle, wherein the transmission is at least partially arranged in a saw arm housing;

a saw blade fastened to a saw arm and rotatable by the drive spindle in a direction of rotation about the axis of rotation;

a saw blade flange, the saw blade arrangeable via the saw blade flange on the drive spindle for rotation therewith; and a lock device, the saw blade flange being adjustable by the lock device between a locked state and an unlocked state, in the locked state the saw blade flange being connected to the drive spindle for rotation therewith, and, in the unlocked state, the saw blade flange being adjustable in relation to the drive spindle, in the unlocked state of the saw blade flange, the drive spindle being blocked in the direction of rotation of the saw blade and rotatable about the axis of rotation in a counter direction counter to the direction of rotation.

2. The wall saw as recited in claim 1 further comprising a motorized feed unit with a guide carriage and a feed motor, the saw head being arranged on the guide carriage and movable by the feed motor along a guide rail in a feed direction.

3. The wall saw as recited in claim 1 wherein the lock device has a tie rod guided in an interior of the drive spindle, and a first connector, and the saw blade flange has a second connector, wherein the first and second connectors are connectable with a force-ft or form-fit.

4. The wall saw as recited in claim 3 wherein, in the locked state, the first and second connectors are connected in the force-fit or the form-fit.

5. The wall saw as recited in claim 1 further comprising a safety device.

6. The wall saw as recited in claim 5 wherein the safety device has a lever, a latch and an axle element connecting the lever and the latch to each other.

7. The wall saw as recited in claim 6 wherein in the locked state of the saw blade flange, the lever is adjustable between a first and second end position, wherein the latch blocks a transmission of torque in the direction of rotation of the saw blade in the first end position of the lever and releases same in the second end position of the lever.

8. The wall saw as recited in claim 6 wherein in the unlocked state of the saw blade flange, the latch blocks a rotation of the drive spindle in the direction of rotation of the saw blade and releases same in the counter direction directed counter to the direction of rotation.

* * * * *